United States Patent [19]

Fischer

[11] 4,283,108

[45] Aug. 11, 1981

[54] CONTACT BLOCK WITH RESILIENT SOCKET CONTACTS

[76] Inventor: Artur Fischer, Weinhalde 34, D-7244 Waldachtal 3, Tumlingen, Fed. Rep. of Germany

[21] Appl. No.: 77,089

[22] Filed: Sep. 19, 1979

[30] Foreign Application Priority Data

Sep. 22, 1978 [DE] Fed. Rep. of Germany ..... 2841234

[51] Int. Cl.[3] ..... H01R 9/24

[52] U.S. Cl. ..... 339/198 K; 339/198 S; 339/258 R; 339/262 R

[58] Field of Search ..... 339/198 R, 198 K, 198 S, 339/198 P, 258 R, 258 F, 258 P, 262 R, 262 F, 191 R, 191 M, 192 R

[56] References Cited

U.S. PATENT DOCUMENTS

| | | | |
|---|---|---|---|
| 949,123 | 2/1910 | Klein | 339/262 R |
| 2,162,453 | 6/1939 | Field | 339/192 R |
| 2,666,189 | 1/1954 | Cook | 339/198 P |
| 2,881,407 | 4/1959 | Winter | 339/191 R |
| 2,989,722 | 1/1961 | O'Donnell | 339/191 R |

FOREIGN PATENT DOCUMENTS

| | | | |
|---|---|---|---|
| 125794 | 10/1947 | tralia | 339/258 R |
| 1393059 | 5/1975 | United Kingdom | 339/198 R |

*Primary Examiner*—John McQuade
*Attorney, Agent, or Firm*—Michael J. Striker

[57] ABSTRACT

A contact block has a plurality of contact units each formed by two U-shaped strips inserted one inside the other. The strips have base portions connected with one another and with a support member by rivets. Each strip has two lateral portions each provided with a slot extending over a part of the length thereof so as to form two resilient tongues in each lateral portion. Thereby, each contact unit has eight tongues forming four contacts. The contacts are separated from one another by a grid of insulating material.

12 Claims, 3 Drawing Figures

CONTACT BLOCK WITH RESILIENT SOCKET CONTACTS

BACKGROUND OF THE INVENTION

The present invention relates to a contact block forming a part of an experimental construction kit for assembling circuits from electrical and electronic construction elements.

Contact blocks of the above-mentioned general type are known in the art. A known contact block has a plurality of contacts which are arranged at regular intervals from one another, and leads can be brought into contact with these contacts. In the known contact block, the contacts of each contact junction point or contact unit are arranged in line, one behind the other, and at relatively large distances from one another. A great number of contact units is necessary in such a construction, in order to produce a versatile contact block. This results in that a very large contact block is required because of the widely spaced arrangement of the contact units. Also, the functional clarity of a circuit which begins on the contact block, suffers because of the wide spacing of the contacts of the contact unit and thereby the spacing of the leads of the electrical construction elements, which leads are arranged at the same contact units. As the construction process of the circuit progresses, it becomes more and more difficult, despite the respective marking of the associated contacts, to locate the region of a contact unit and thus the available connection point for further leads of the construction elements.

Insertion of several leads into a single contact which is made correspondingly larger, is not possible because of the varying cross-sectional dimensions of the leads. In addition, the leads may be twisted during previous application. The known contacts usually are composed of two spring tongues which are resiliently directed toward one another, and the leads of the electrical or electronic construction elements are introduced therebetween. Even a small deviation in the cross-sectional dimension of the lead of one construction element from that of another construction element impairs the contact of the lead with the smaller cross sectional dimension. Especially in electronic circuits, it is particularly important that the electrical contact guarantee an efficient transmission of current in order to avoid disruptive influences on the circuit.

SUMMARY OF THE INVENTION

Accordingly, it is an object of the present invention to provide a contact block which avoids the disadvantages of the prior art.

More particularly, it is an object of the present invention to provide a contact block in which the space required for contacts of individual contact units is kept to a minimum, which is simple and inexpensive to manufacture, and which provides for reliable contact action.

In keeping with these objects and with others which will become apparent hereinafter, one feature of the present invention resides, briefly stated, in a contact block in which each contact is composed of two U-shaped strips located one inside the other and each having two lateral portions each subdivided by a slot into two resilient tongues, so that each contact unit includes eight such tongues. One tongue of the inner strips and one tongue of the outer strip together form one contact into which a lead can be inserted between these two tongues. Thus, each contact unit has four contacts which are separated from each other by separating means.

In such a construction the contact units are located adjacent to one another and each combine four contacts, so that it is possible to accommodate a great number of contacts in an extremely small space, despite the fact that each contact is formed by two resilient tongues and each lead is arranged in its own contact. In such a construction reliable and trouble-free electrical contact of the leads is attained regardless of their cross-sectional dimensions.

Another feature of the present invention is that free end portions of the inner and outer strips may be bent inwardly and outwardly, respectively, so as to form V-shaped receiving openings therebetween. This facilitates insertion of the leads in the regions between the tongues formed by the inner and outer strips.

Still another feature of the present invention is that means for separating the contacts from one another may be formed by a grid extending between the end portions of the inner strips and engaging in the slots of the lateral portions of the inner and outer strips. Such a separating means has a simple construction and reliably performs its functions.

A further feature of the present invention is that the lateral portions of the inner and outer strips may have crimped sections located inwardly adjacent to the above-mentioned V-shaped openings, and more particularly in the region of the base of the latter. Thereby, wave-like contact surfaces on the adjacent tongues are produced. During insertion of the lead between the crimped sections with mechanical contact of the lead with the wave-like contact surfaces facing toward one another, layers of dirt or oxide are removed from the lead. The crimped sections may be manufactured by a respectively designed punch utilized for punching out of the strips.

Still a further feature of the present invention is that the inner strip and the outer strip of each contact unit is electrically connected with one another by a rivet, and are also secured by the same rivet to a housing of the contact block. The rivet may serve simultaneously for fastening the contact block to a printed circuit board, and for making the connection between the contact unit and a printed conductor path, which, in turn, is connected to an electronic switch element.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
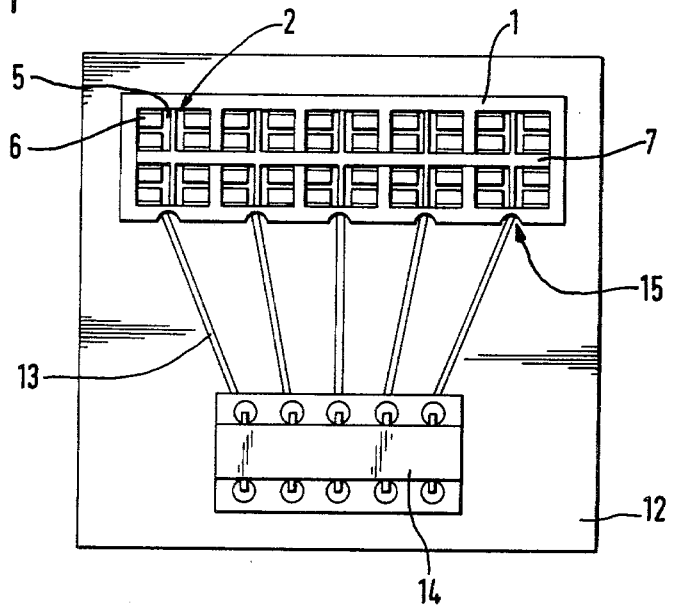
FIG. 1 is a plan view showing a contact block in accordance with the present invention, mounted on a printed circuit board.
Figure 2:
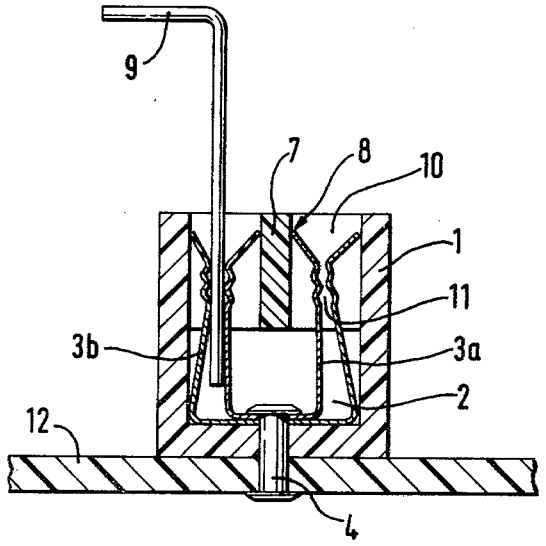
FIG. 2 is an enlarged sectioned lateral view of an individual contact unit of the contact block in accordance with the present invention.

A contact block in accordance with the present invention has a housing which is identified by reference numeral 1 and provided with a plurality of recesses 2 each accommodating one contact junction point or contact unit.

Each contact unit is formed by two contact strips which are U-shaped and inserted one inside the other. The inner strip is identified by reference numeral 3*a*, whereas the outer strip is identified by reference numeral 3*b*. The strips 3*a* and 3*b* of each contact unit are electrically connected with one another by a rivet 4. The rivets 4 also connect the strips 3*a* and 3*b* to the housing 1 of the contact block. As can be seen from the drawing, the rivet 4 extends through base portions of the inner strip 3*a* and the outer strips 3*b*. The base portions of both strips together form a common base of the contact unit.

Figure 3:
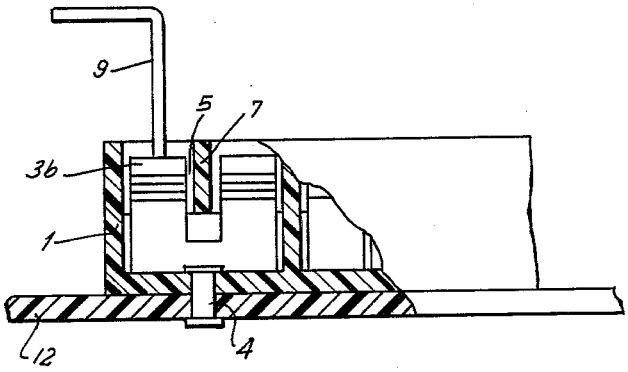
FIG. 3 is also an enlarged sectioned lateral view of the individual contact unit of the inventive contact block, but seen in direction transverse to the direction in which the view of FIG. 2 is seen.

Each of the strips 3*a* and 3*b* has two lateral portions extending from the base portions and having free ends spaced from the latter. A slot 5 is provided in each lateral portion of each strip. The slot 5 extends from the free end of each lateral portion over a part of the length of the latter, as can be seen particularly in FIG. 3. Thereby each lateral portion is subdivided into two resilient tongues, and each contact unit includes eight such resilient tongues forming four contacts 6 per contact unit. Each contact 6 is formed by one resilient tongue of the inner strip 3*a* and a respective one of the resilient tongues of the outer strip 3*b* of the same contact unit.

The individual contacts are separated from one another by a grid 7 of electrically insulating material, which engages in the slots 5 of the lateral portions of the strips 3*a* and 3*b*, on the one hand, and in a gap 8 between the lateral portions of the inner strip 3*a*, on the other hand. The grid 7 also serves to position the resilient tongues so as to exert the greatest possible resilient force on a lead 9 inserted in the contact.

End sections of the lateral portions of the inner strip 3*a* and of the outer strip 3*b* are bent inwardly and outwardly, respectively. Thereby, a V-shaped receiving opening 10 is formed in the region of free ends of the lateral portions of the strips 3*a* and 3*b*. This facilitates the insertion of the leads 9 in between the lateral portions of the strips 3*a* and 3*b*, i.e., into each contact.

Each lateral portion of the strips 3*a* and 3*b* has a crimped section 11 located inwardly adjacent to a respective one of the bent sections in the region starting from the base of the latter. The crimped sections 11 of the lateral portions forming each contact have wave-like contact surfaces facing toward one another. When the lead 9 is inserted through the receiving opening 9 into the region of the crimped sections 11 and advanced through the latter, layers of dirt and oxide are removed from the lead because the lead forcedly slides relative to the wave-like contact surfaces.

Each contact unit is electrically connected by the rivet 4, which mounts the strips 3*a* and 3*b* in the recess 2 of the housing 1, and via a conductive path 13 printed on a circuit board 12, to a specific terminal of an electronic switch element 14 arranged on the circuit board 12. The coordination of the contact units with the individual terminals may be additionally indicated by marks 15.

It will be understood that each of the elements described above, or two or more together, may also find a useful application in other types of constructions differing from tye types described above.

While the invention has been illustrated and described as embodied in a contact block of an experimental construction bit, it is not intended to be limited to the details shown, since various modifications and structural changes may be made without departing in any way from the spirit of the present invention.

Without further analysis, the foregoing will so fully reveal the gist if the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A contact block of an experimental construction kit for connecting electrical and electronic construction elements, comprising a support element; a plurality of contact units supported by said support element and each composed of two U-shaped contact strips inserted in one another, said strips having base portions connected with one another so as to form a common base, and each of said strips having two lateral portions extending from the base portion of the respective strip, each of said lateral portions having a free end spaced from the base portion and being provided with a slot extending from the free end of the respective lateral portion in the direction toward the base portion of the same strip and over at least a part of the length of the respective lateral portion, so that each of said lateral portions is subdivided into two resilient tongues and thereby each of said contact units comprises eight tongues which form four contacts each composed of two of said eight tongues and arranged to receive a conductor therein; and means for electrically separating said contacts from each other.

2. A contact block as definned in claim 1, wherein the strips of each contact unit includes an inner strip and an outer strip, the lateral portions of said inner strip having end sections located adjacent to said free ends thereof and bent inwardly of said contact unit, the lateral portions of said outer strip having end sections located adjacent to said free ends thereof and bent outwardly of said contact unit.

3. A contact block as defined in claim 2, wherein the inwardly bent end section of each tongue of each of said inner strips and the outwardly bent end section of a respective one of said tongues of the outer strip of the same contact unit, form therebetween a V-shaped receiving opening through which the conductor can be inserted in between said tongues.

4. A contact block as defined in claim 1, wherein the strips of each contact unit include an inner strip and an outer strip, the lateral portions of said strips having end sections located adjacent to said free ends thereof, said electrically separating means being a member of insulating material inserted in between the end sections of said lateral portions of said inner strips of said contact units, and in the slots of said lateral portions of said inner strips and said outer strips of said contact units.

5. A contact block as defined in claim 4, wherein said member is a grid.

6. A contact block as defined in claim 1, wherein said contact units are arranged at regular intervals from one another.

7. A contact block as defined in claim 3, wherein each of said lateral portions of said inner and outer strips has a further section located adjacent to and inwardly of the bent section of the same and being crimped so as to form a wave-like contact surface.

8. A contact block as defined in claim 7, wherein each of said openings has an inner end facing toward said common base, said crimped sections extending from said inner ends of said V-shaped openings toward said common base over a part of the length of said lateral portions.

9. A contact block as defined in claim 1; and further comprising a plurality of connecting members each electrically connecting with one another the inner strip and the outer strip of each contact unit and also connecting the same to said support element.

10. A contact block as defined in claim 9, wherein said connecting members are rivets.

11. A contact block as defined in claim 10, wherein each of said rivets extends through the base portions of the inner strip and the outer strip of the same contact unit.

12. A contact block as defined in claim 1, wherein said support element has a plurality of recesses each accommodating a respective one of said contact units.

* * * * *